United States Patent [19]

Hardy et al.

[11] Patent Number: 4,473,963

[45] Date of Patent: Oct. 2, 1984

[54] SIGN SUPPORT

[75] Inventors: Stephen N. Hardy, Akron; John A. Johnson, Strongsville, both of Ohio

[73] Assignee: American Greetings Corporation, Cleveland, Ohio

[21] Appl. No.: 430,885

[22] Filed: Sep. 30, 1982

[51] Int. Cl.[3] ..... G09F 3/18

[52] U.S. Cl. ..... 40/10 R; 40/11 R; 40/152.1; 40/124.1; 248/460; 248/469; 248/174; 248/468; 248/205.3; 248/473

[58] Field of Search ..... 40/10 R, 11 R, 152.1, 40/152, 154, 158 R, 155, 124.1; 248/473, 205.3, 466, 469, 460, 174, 176

[56] References Cited

U.S. PATENT DOCUMENTS

| | | | |
|---|---|---|---|
| 2,064,047 | 12/1936 | Wertz | 248/468 |
| 3,019,540 | 2/1962 | Chudek, Jr. | 248/469 |
| 3,385,551 | 5/1968 | McKay | 248/470 |
| 3,525,493 | 8/1970 | Chrietzberg et al. | 40/11 R |
| 3,763,583 | 10/1973 | Gregg | 40/124.1 |
| 4,125,243 | 11/1978 | Liptak | 40/152.1 |
| 4,229,892 | 10/1980 | Hueter et al. | 40/152.1 |
| 4,234,148 | 11/1980 | Maddestra et al. | 40/124.1 |

FOREIGN PATENT DOCUMENTS

| | | | |
|---|---|---|---|
| 610986 | 10/1948 | United Kingdom | 248/473 |

*Primary Examiner*—Gene Mancene
*Assistant Examiner*—James Hakomaki
*Attorney, Agent, or Firm*—Maky, Renner, Otto & Boisselle

[57] ABSTRACT

Apparatus for releasably attaching a sign to a display stand. The sign comprises a sheet of material folded into a central section and a pair of upstanding display sections. The sign support inludes a pair of pivotally connected support members. One support member is releasably attached to the support surface and supports the central section of the sign. The other support member engages the display sections of the sign and maintains them in an upright orientation relative to the support surface. Mating catches on the support members secure the support members to each other in order to securely engage the sign. The engagement between the mating catches may be released in order to pivot the support members relative to each other so that the sign may be removed from the sign support, without removing the sign support from the support surface. The sign support is preferably formed as a unitary, molded plastic article.

18 Claims, 10 Drawing Figures

SIGN SUPPORT

BACKGROUND OF THE INVENTION

This invention relates to structure for supporting a display sign on an article such as a display stand.

Retail stores commonly employ display stands to display merchandise for sale. Often, the display stands are used in connection with items which are periodically or seasonally changed, e.g., greeting cards and other holiday related merchandise. The display stands may have signs attached to them to draw the attention of customers and to identify the goods being displayed.

When the goods carried by a display stand are changed, the sign associated with the display stand must also be changed, to reflect the change in the items being carried by the display stand.

SUMMARY OF THE INVENTION

The present invention relates to a new and useful structure for supporting a sign from an article such as a display stand. The support structure can securely connect a sign with a display stand, but in a way which also allows ready replacement of the sign when the merchandise associated with the display stand is changed. Further, the support structure is designed to support a sign in an aesthetically pleasing manner. Additionally, the support structure is both economical and efficient to construct, because it can be formed from relatively small amounts of moldable plastic material, and as a unitary molded structure.

The present invention also provides a specially formed sign which is associated with the sign support. The sign comprises a sheet of material which is formed (preferably folded) into a planar central section and a pair of display sections. The support structure releasably engages both the planar central section and the pair of display sections of the sign and supports the display sections in an upstanding relation to the display stand. The support structure releasably attaches to the support surface of an article such as a display stand, but is also designed so that it can be released from engagement with the sign while remaining attached to the display stand. Thus, the sign can be changed without releasing the support structure from the display stand.

BRIEF DESCRIPTION OF THE DRAWINGS

Further features of the present invention will become apparent from the following detailed description taken in connection with the accompanying drawings wherein.

DETAILED DESCRIPTION OF THE PREFERRED EMBODIMENT

Figure 1:
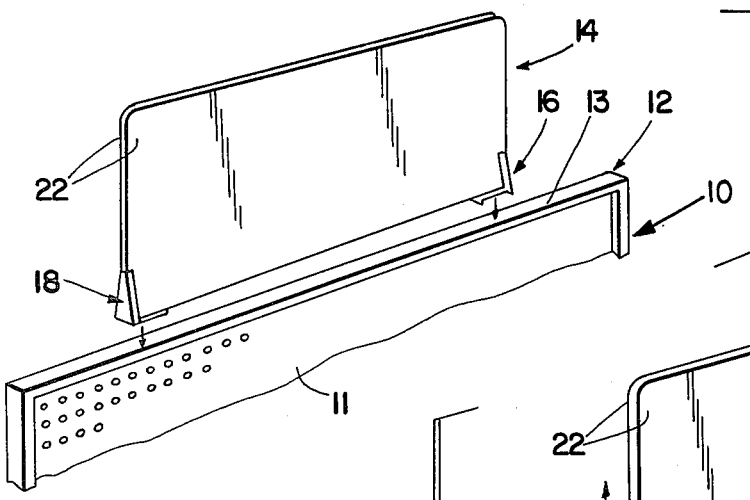
FIG. 1 is a schematic illustration of a fragmentary portion of a display stand with support structure and sign in the process of being placed on the display stand.
Figure 2:
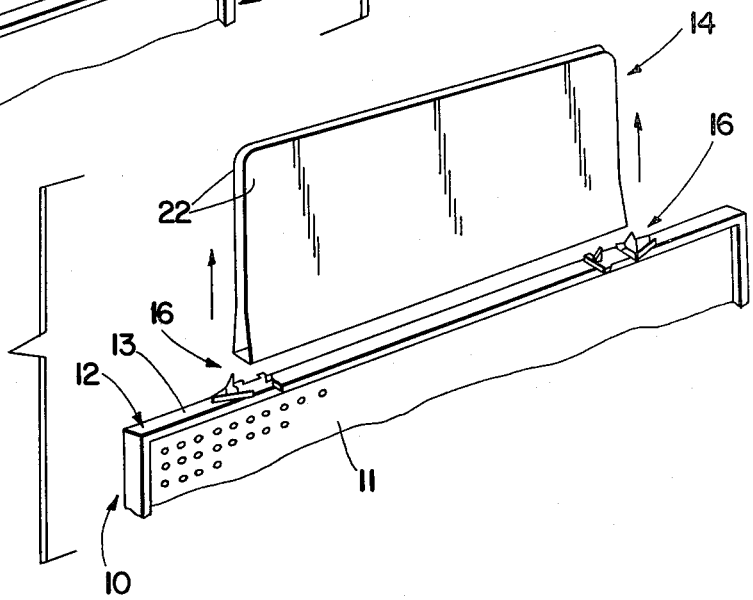
FIG. 2 is a schematic illustration showing the sign being removed from the display stand while the support structure remain engaged with the display stand.

FIGS. 1 and 2 schematically illustrate a display stand 10 having an apertured back wall 11 and a top wall 12. Typically, the aperatured back wall 11 is engaged by brackets that support display shelves for articles of merchandise.

A sign 14, is connected with the horizontal, upper surface 13 of the top wall 12. A pair of sign supports 16, attach the sign 14 to the surface 13, and support the sign 14 in an upright position relative to the display stand. In order to change the sign 14, the sign supports 16 are released from engagement with the sign 14, and are engaged with a new sign.

The sign 14 is preferably a sheet of material such as paper, cardboard, plastic, etc. which can be folded along a pair of lines 21 to form a central planar section 20 and a pair of display sections 22. The display sections 22 extend out of the plane of the central section 20, and carry the display associated with the articles on the display stand 10. The central planar section 20 of the sign 14 includes a pair of holes 24 extending therethrough (FIG. 3), and whose purpose will be explained further hereinafter.

Each of the sign supports 16 is a molded, unitary article, preferably formed of a butadiene styrene resin such as sold by Phillips Petroleum under the designation KRO-1. Such a material provides the strength and rigidity desired in certain parts of the sign support 16, and also allows formation of flexible and long lasting hinges, flexible levers, etc. in other parts of the sign support, as discussed more fully hereinafter.

Each sign support 16 includes a bottom section 26 which engages the central planar portion 20 of a sign 14, and a side section 28 which engages parts of both display sections 22 of the sign 14. The bottom section 26 and the side section 28 of the sign support 16 are connected to each other by a hinge 30 which is formed in the plastic as a living hinge. The hinge 30 is designed to allow the bottom section 26 and the side section 28 to pivot relative to each other, about an axis 29, between the open orientation shown in FIG. 7 and the closed orientation shown in FIG. 8. The bottom and side sections 26, 28 are pivoted to the open orientation shown in FIG. 7 when it is desired to release the sign support 16 from a sign 14, and they are pivoted to the open orientation of FIG. 8 when it is desired to engage the sign support 16 with a sign.

Figure 5:
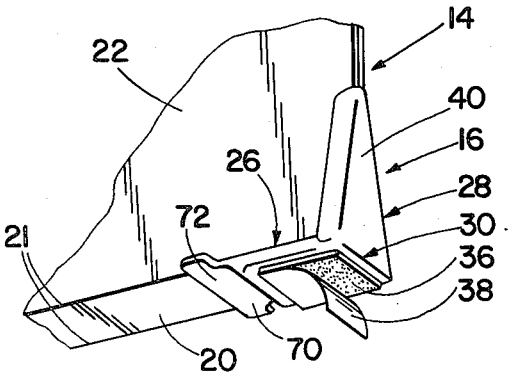
FIG. 5 is a fragmentary schematic illustration of a support structure and a sign connected therewith, and illustrating the means which secures the support structure to a display stand.

The bottom section 26 of the sign support 16 includes a planar base 60 which is generally rectangular. The base 60 has a bottom surface 61 which carries an adhesive pad 36 that enables the bottom section 26 to be releasably attached to the top wall 12 of the display stand 10. If desired, the adhesive layer on the pad 36 can be covered by a sheet of material 38 (FIG. 5) which is peeled off when it is desired to attach the sign support to a display stand. Also, one or more support members 78 protrude outward from the parts of the bottom surface 61 which the adhesive pad 36 is not secured to. The support member(s) 78 help maintain the base 60 level on the display stand 10.

The bottom section 26 includes parallel end ribs 62, 64, and a center rib 66, which are integral with the base 60, and all of which extend out of the plane of the base 60 in directions normal to the base 60. The end ribs 62, 64 and the center rib 66 help rigidify the base 60, and also define longitudinally extending channels for the central planar section 20 of a sign 14, as described more fully hereinafter. The width of the end ribs 62, 64 and the center rib 66 is the same throughout most of their respective lengths, but the end ribs 62, 64 have recessed portions **62*a*, 64*a*, disposed adjacent the hinge 30**, whose purpose will be described hereinafter.

Figure 8:
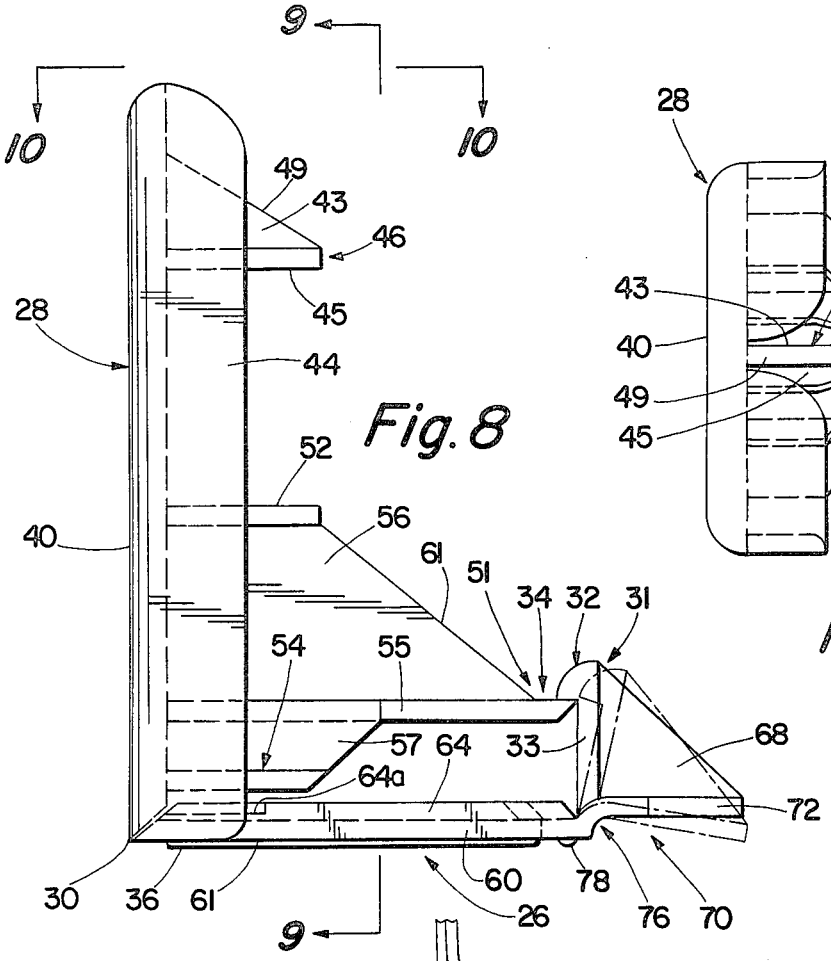
FIG. 8 is a side elevational view of the support structure in a closed position.

At the end of the base 60 which is remote from the hinge 30, the bottom section 26 includes an integral, resilient lever 70. The lever 70 is integrally connected to the base 60 by a curved portion 76 that has a memory which biases the lever 70 to a position which is spaced above the bottom surface 61 of the base 60. FIG. 8 shows, in full lines, the position in which the lever 70 is biased to.

A locking member 31 is integrally connected with the flexible, curved portion 76. The locking member 31 incudes a wall 33 which extends normal to the base 60, and a catch 32 at the distal end of the wall 33. The catch 32 is designed to engage a matching catch 34 on the side section 28, when the bottom and side sections 26, 28 are in the relative orientation shown in FIG. 8. An additional wall 68, extending normal to the base 60, extends between and interconnects the lever 70 with the wall 33 of the locking member 31.

When the base 60 is secured to a display stand, and the lever 70 is based to the position shown in full lines FIG. 8, the lever 70 is disposed above the top wall 12 of the display stand. When downward pressure is applied to the lever 70, the curved portion 76 and the lever 70 flex, or pivot, to the orientation such as shown in phantom in FIG. 8 in order to release the catch 32 from the mating catch 34 connected with the side section 28. A pair of tabs 72, disposed in the plane of the lever 70, extend outwardly from the lever 70 (see FIG. 6). Downward pressure is applied to the tabs 72, to cause the lever 70 and the curved portion 76 to flex from the full line position of FIG. 8 to the orientation shown in phantom lines in FIG. 8 in order to release the catch 32 from the mating catch 34 on the side section 28.

Figure 6:
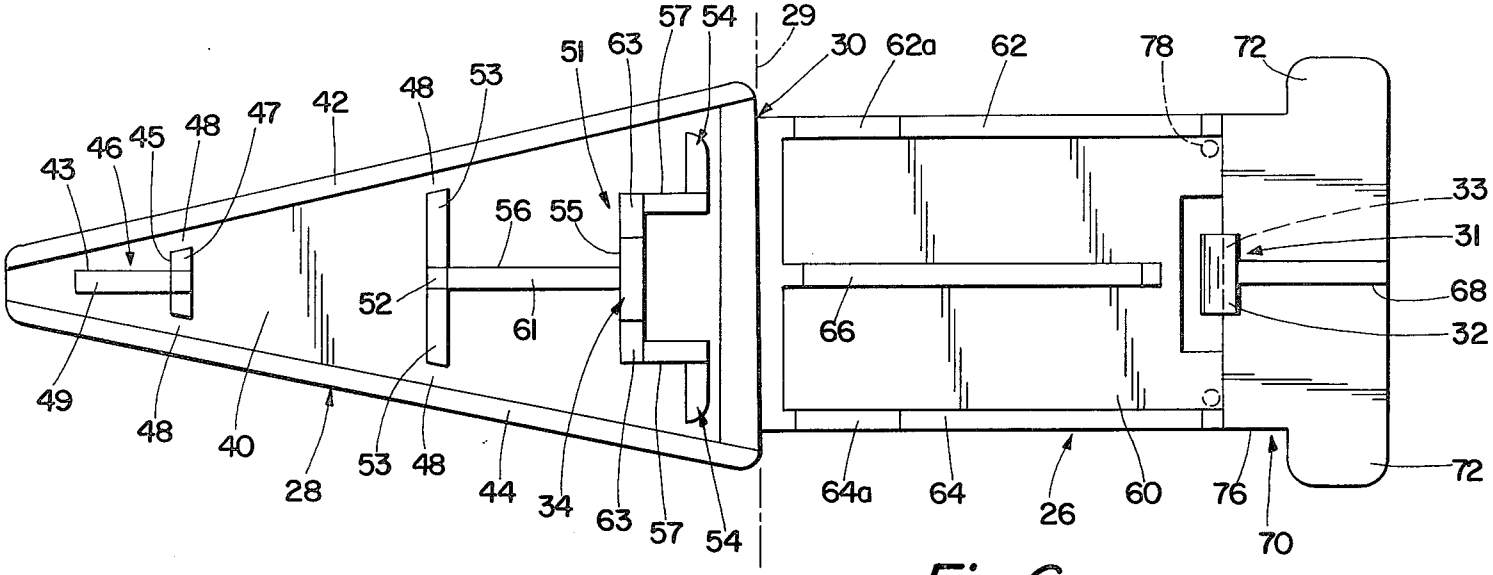
FIG. 6 is a top plan view of a support structure according to the invention, in an open position.

The side section 28 includes a generally planar side wall 40 which is triangularly shaped (see FIG. 6). A pair of integral ribs 42, 44 extend out of the plane of the side wall 40, in directions normal to the side wall 40. The ribs 42, 44 converge toward each other, and form part of a pair of guide channels 48 which engage a sign, as described hereinafter.

Figure 10:
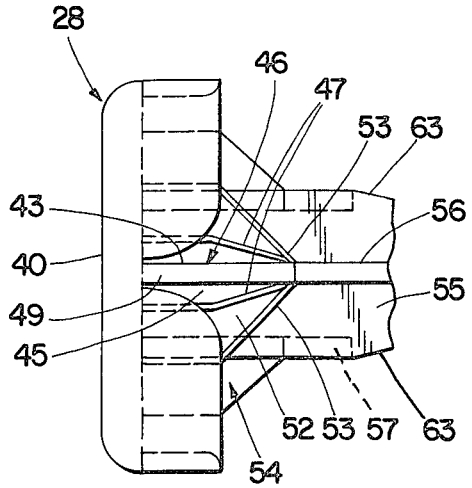
FIG. 10 is a fragmentary view of the support structure of FIG. 8, taken from the direction 10—10.

The side section 28 also includes an integral upper guide member 46 which extends out of the plane of the side wall 40, near the narrow end of the converging ribs 42, 44. The upper guide 46 comprises a generally T-shaped structure with a wall 43 that extends perpendicular to the main pivot axis 29, and another wall 45 that extends parallel to the main pivot axis 29, but which terminates in spaced relation to the ribs 42, 44. The wall 43 has a pair of converging surfaces 47 (FIG. 10), and the wall 45 has a slanted outer surface 49 (FIG. 10), all of which are designed to promote proper engagement of the side section 28 with a sign 14. The spaces between the wall 45 and the ribs 42, 44 defines part of the guide channels 48 for the sign.

The side section 28 has a central wall 52 integral with the triangular side wall 40 and extending out of the plane of the triangular side wall 40. The central wall 52 extends parallel to the wall 43, and terminates in spaced relation to the converging ribs 42, 44. The spaces between the central wall 52 and the ribs 42, 44 further define part of the guide channels 48 for the sign. Further, the central wall 52 has a pair of converging surfaces 53 (FIG. 10), which facilitate proper engagement of the side section 28 with a sign 14.

Figure 7:
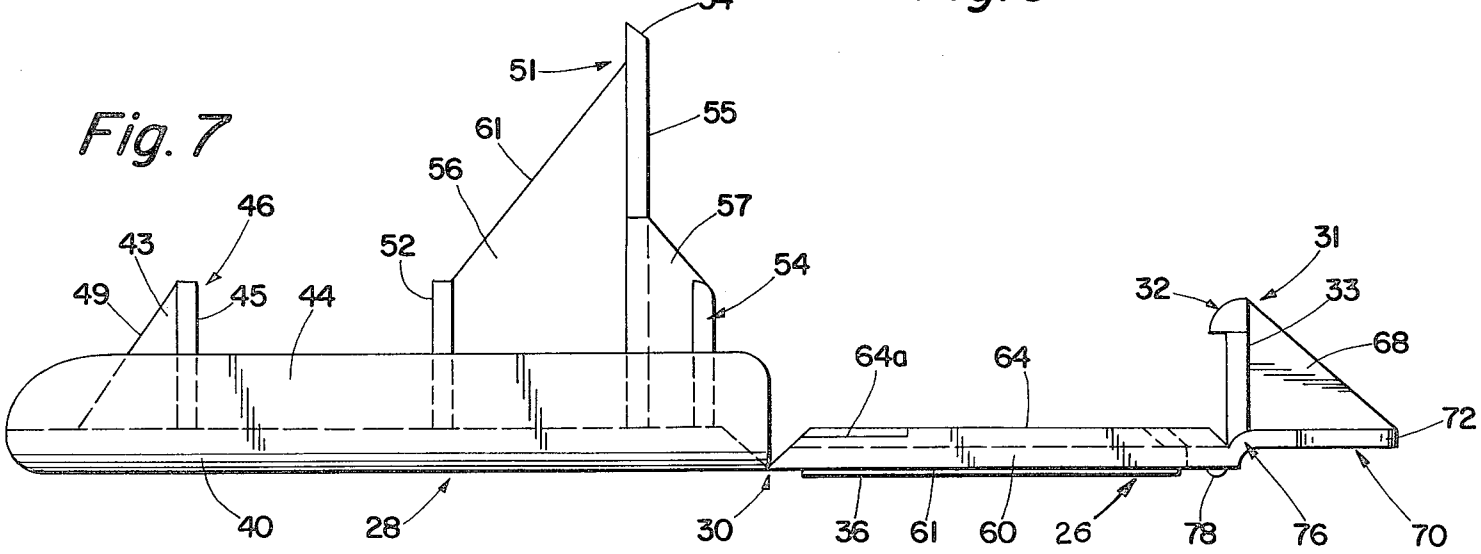
FIG. 7 is a side elevational view of the support structure of FIG. 6, taken from the direction 7—7.

Further toward the wide end of the triangular side wall 40, a locking member 51 includes a wall 55 which extends out of the plane of the side wall 40 and includes at its distal end the catch 34. The wall 55 has surfaces 63 (FIGS. 6, 10) which converge toward its outer distal end. Additionally, there is a connecting wall 56 which interconnects the central wall 52 with the wall 55. As seen by FIG. 7, the connecting wall 56 includes a surface 61 that extends diagonally relative to the planar base 40.

Still closer to the wide end of the triangular side wall 40, a pair of integral lower walls 54 extend out of the plane of the side wall 40 and in directions parallel to the walls 52 and 43. A pair of connecting walls 57 interconnect the lower walls 54 with the wall 55, and the lower walls 54 extend outwardly toward the ribs 42, 44, but terminate in spaced relation to the ribs 42, 44. The walls 54, 52 and 43 are all spaced from the ribs 42, 44 by approximately the same distance to form the guide channels 48 for the sign.

Figure 3:
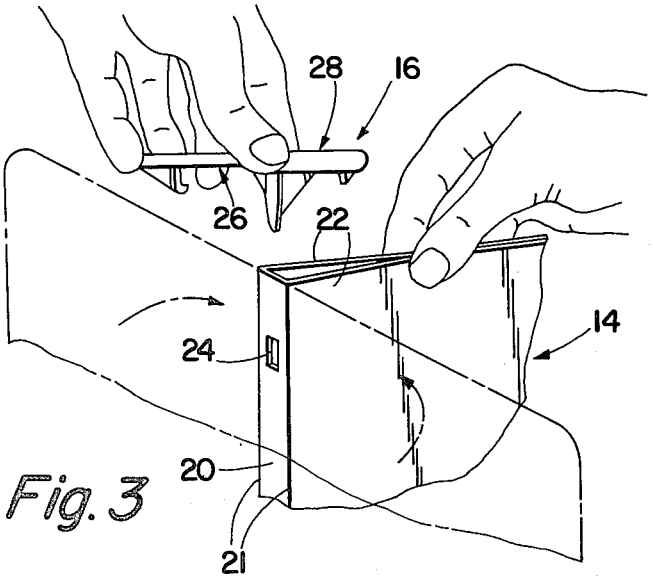
FIG. 3 is a fragmentary schematic illustration of a sign being folded in preparation to being initially connected with a support structure.
Figure 4:
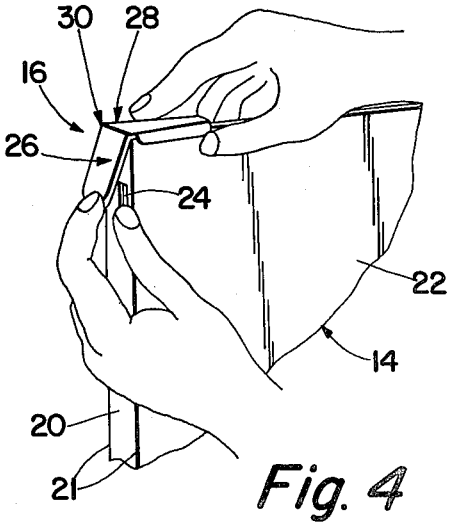
FIG. 4 is a fragmentary schematic illustration of a further step in securing a support structure to a sign.
Figure 9:
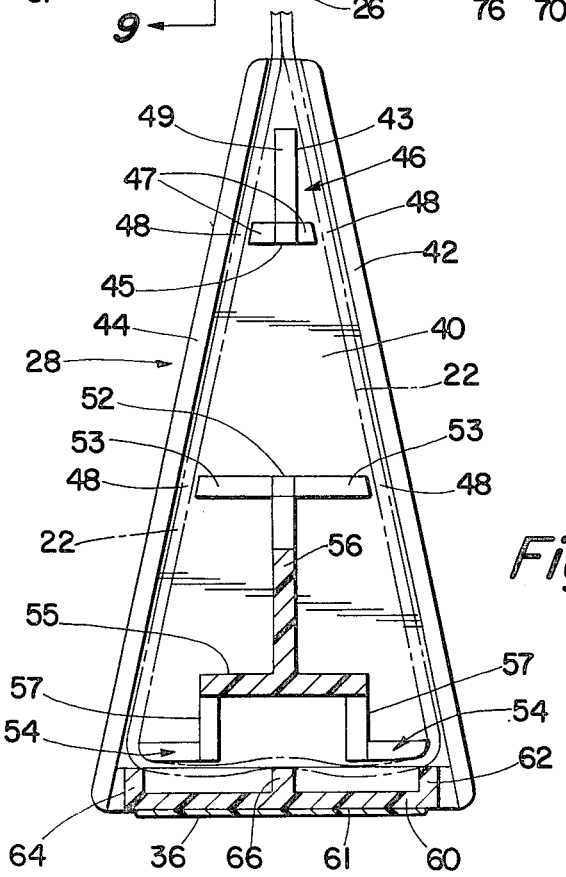
FIG. 9 is a sectional view of the support structure of FIG. 8 taken generally along lines 9—9, with a portion of a sign shown in phantom.

When initially connecting a sign 14 with a display stand, the sign 14 is first folded to form its planar central section 20 and display sections 22, and the display sections 22 are "pinched" together, to form a generally triangular-shaped opening adjacent the planar central section 20. A sign support 16 is engaged with the sign by inserting the protruding members of the side portion 28 into the triangular opening in the sign 14 and guiding the edges of the display sections of the sign into the guide channels 48 formed in the side section 28. FIG. 3 shows a sign support 16 in the process of being inserted into the triangular opening in a sign 14, and FIG. 9 shows, in phantom, the orientation of the edges of the sign relative to the guide channels 48. The side section 28 is inserted as far as possible into the triangular opening in the sign, so that the edges of the display sections 22 are disposed adjacent the planar side wall 40. The diagonal wall 61 and the converging surfaces 47, 49, 53 on the protruding members facilitate insertion of those members into the triangular opening in the sign 14, and also help maintain that triangular opening in the sign 14. Also, they help guide the edges of the sign into the guide channels 48. By establishing and maintaining the triangular opening near the central planar section 20 of the sign, it is believed that a secure and stable base for the sign is provided.

After the sign section 28 is engaged with the sign, the bottom section 26 is pivoted about the axis 29 toward the side portion 28. As the bottom section 26 is pivoted, the space between the ribs 62, 64, 66 serve as guide channels for the central planar portion 20 of the sign. Further, as the bottom section 26 is pivoted, the locking portion 32 extends through a hole 24 in the central planar section 20 of the sign. As the bottom section 26 pivots to the orientation shown in FIG. 8, the catch 32 on the bottom section 26 will snap over the mating catch 34 connected with the side section 28. Also, as the base and side sections 26, 28 pivot to the orientation of FIG. 8, the lower walls 54 will partially clamp the central planar section 20 of the sign in the guide channels formed by ribs 62, 64, 66. The recesses 62*a*, 64*a*, enable this clamping action to occur while allowing the base and side sections 26, 28 to pivot all the way to the position of FIG. 8. Thus, the sign support 16 will be locked in the orientation shown in FIG. 8, and will engage the sign 14 in such a manner that the triangular opening in the sign is maintained adjacent the central planar section 20 of the sign.

A similar sign support 16 is connected to the opposite end of the sign, as shown schematically in FIG. 1. Once both sign supports 16 are engaged to the ends of the sign 14, the adhesive pads 36 on the sign supports are secured to the top wall 12 of the display stand 10. The adhesive pads 36 attach the sign supports 16 firmly to the display stand 10. The interlocked catch members 32, 34 hold the bottom and side sections 26, 28 of the sign supports in the positions shown in FIGS. 1 and 8, and, in turn, the side sections 28 cooperate with the bottom sections 26 to hold the sign 14 in the orientation of FIG. 1, with the central planar section 20 adjacent the top wall 12, and the display sections 22 of the sign in upstanding relation to the display stand 10.

With the invention, it is possible to replace the sign 14 without removing the sign supports 16 from the display stand 10. As discussed above, when a sign support 16 is adhesively attached to the display stand, the lever 70 of that sign support is disposed above the top wall 12 of the display stand. The lever 70 can be flexed by downward pressure on the tabs 72. When the lever 70 is flexed, it disengages the locking members 32, 34 from each other. The side section 28 can then be pivoted so that its locking catch 34 and its guide channels 48 are disengaged from the sign. The sign can now be removed from the sign supports 16, and another sign can be oriented with its central portion 20 disposed adjacent the bottom portions 26 of the sign support 16. The display sections 28 of the new sign are then "pinched" together to form a triangular opening in the new sign. The side sections 28 of the sign supports 16 are pivoted, so that their locking catches 34 are inserted between the display sections 78, and the edges of the display sections are guided into the respective guide channels 48 of the side section 28. As the side section 28 reach the orientation of FIG. 9, their locking catches 34 will engage the locking catches 32 on their bottom portions 26, thereby securing the new sign with the sign supports and with the display stand 10.

As seen from FIG. 1, when a pair of sign supports 16 are engaged with a sign 14, the sign supports 16 appear to form corner pieces along the lower portions of the sign. The sign supports 16 do not interfere with the visual impression of the display sections 22 of the sign. In fact, the sign supports 16 are believed to enhance the overall aesthetic appearance of the sign.

Moreover, the sign supports 16 are efficient and economical to manufacture. Eash sign support 16 can be molded as a unitary plastic article, and only one mold design is required since the sign supports at each end of a sign are identical. Also, only relatively small amounts of plastic are required to form an entire sign support 16; e.g., the preferred length of the sign support shown in FIG. 7 is about 2.4 inches, the maximum width of the sign support is about 1.4 inches and the protruding elements (e.g., locking member 51) extend out of the base 60 or the side wall 40 to a maximum length of about 1.4 inches.

What is claimed is:

1. Apparatus for displaying information from a support surface, comprising a sign including a pair of display sheet sections and a central section interconnecting said display sheet sections, and support means engaging said central section and both of the display sheet sections of said sign, said support means having means for engaging the support surface and being adapted to support said sign from the support surface with the central portion of the sign disposed adjacent the support surface and said display sheet sections of said sign disposed in an upright orientation relative to the support surface.

2. Apparatus as set forth in claim 1 wherein said means for engaging the supporting surface includes means releasably attaching said support means to the support surface, said support means being releasably engageable with said central section and both of said display sheet sections of said sign while said support means is attached to the support surface, to allow changing the sign on the support surface while said support means remains attached to the support surface.

3. Apparatus as set forth in claim 2, wherein said support means comprises bottom means for engaging said central section of the sign and side means for engaging both of said display sheet sections of the sign, said bottom means and said side means being connected in a way which allows said side means to move relative to said bottom means between a first orientation in which said side means does not engage either of said display sheet sections and a second orientation in which said side means engages both of said display sheet sections while said bottom means is engaged with said central section of the sign.

4. Apparatus as set forth in claim 3, further including locking means for maintaining said side and bottom means in said second orientation, said locking means being selectively releasable to allow said side means to move from said second orientation to said first orientation in order to release said side means from engagement with said display sheet sections of said sign.

5. Apparatus as set forth in claim 4 wherein said side means when in said second orientation engages edge portions of said display sheet sections and maintains the portions of said display sheet sections which are adjacent to said central section in a spaced apart converging relationship, means drifting a hole extending through said central section, said locking means comprising a first locking member connected with said side means and a second locking member connected with said bottom means, said first locking member extending between the edge portions and into the area between the converging parts of said display sheet sections when said side and bottom means are in said second orientation, said second locking member adapted to extend through the hole in said central section and into the area between the converging parts of said display sheet sections when said side and bottom means are in said second orientation, said first and second locking members being engageable with each other when said side means is engaging said pair of display sheet sections of the sign and said side and bottom means are in said second orientation.

6. Apparatus as set forth in claim 5, further including release means for selectively releasing the engagement between said first and second locking members, said release means comprising means for moving said second locking member relative to said first locking member while said side and bottom means are in said second orientation and while said bottom means is attached to the support surface to disengage said first and second locking members from each other and allow said side means to move to said first orientation in order to disengage from said sign.

7. Apparatus as set forth in claim 6, including a pair of said support means for engaging opposite ends of said sign.

8. Apparatus as set forth in claim 7, wherein said means for engaging the support surface includes adhesive means for adhesively attaching said bottom means to the support surface.

9. Apparatus as set forth in claim 8, wherein said support means comprises a unitary, molded plastic article.

10. Apparatus for supporting a sign on a support surface, the sign comprising a planar central section and a pair of display sheet sections extending out of the plane of said planar central section, said apparatus comprising (i) a first support member including means for engaging the support surface, said first support member including means for engaging at least a part of said central section of the sign and supporting the central section of the sign in an orientation which is generally parallel to and adjacent with the support surface when said first support member is engaged with the support surface, (ii) a second support member having means for engaging each of the pair of display sheet sections of the sign and maintaining the display sheet sections of the sign in an upstanding orientation relative to the support surface when said first support member is engaging the support surface, said first support member and said second support member being connected in a way which allows said second support member to move relative to said first support member from a first orientation in which said second support member does not engage the pair of upstanding display sections of the sign to a second orientation in which said second support member engages both of the upstanding display sections of the sign, (iii) locking means for maintaining the first and second support members in said second orientation, and (iv) release means for selectively releasing said locking means to allow said support member to move to said first orientation for disengaging a sign therefrom.

11. Apparatus as set forth in claim 10, wherein said second support member includes means integral therewith for engaging both display sheet sections of a sign and for maintaining portions of the display sections of the sign in spaced apart relation to each other when said second member is in said second orientation, said locking means including means extending into the space between the spaced apart portions of the display sheet sections.

12. Apparatus as set forth in claim 11 wherein the central section of the sign has a hole extending therethrough, said locking means including a first locking member integral with said first support member and adapted to extend through the hole in the central section of the sign and into the space between the display sheet sections when said first and second support members are in said second orientation, said locking means further including a second locking member integral with said second support member and adapted to extend between the edges of the display sheet sections and into the space between the display sheet sections when said first and second members are in said second orientation, said first and second locking members having respective means integral therewith for engaging each other when said first and second members are in said second orientation for maintaining said first and second members in said second orientation, said means for selectively releasing said locking means including means for selectively disengaging said first and second locking members.

13. Apparatus as defined in claim 12 including hinge means integral with each of said first and second support members and allowing said first and second support members to pivot between said first and second orientations, said first support member including an integral relatively flat surface for engaging the support surface, and said release means comprising a flexible lever integrally connected with said first support member in a manner that allows it to be selectively pivoted in a predetermined manner relative to said first support member when said first and second support memers are in said second orientation, said flexible lever being integrally connected with said second locking member in a such a way that said second locking member is disengaged frm said first locking member when said flexible lever is pivoted in said predetermined manner.

14. Apparatus as defined in claim 13 wherein said flexible lever is integrally connected with said first support member by means that biases said flexible lever to a position that allows said first and second locking members to engage each other when said first and second support members are in said second orientation.

15. Apparatus as defined in claim 14 wherein said second support member includes integral means defining spaced apart converging channels for engaging the edge portions of the display portions of the sign for holding the display sheet of the sign in spaced apart converging relation to each other when said first and second support members are in said second orientation.

16. Apparatus as defined in claim 15 wherein said second support member comprises a triangular planar base and second rib means extending out of said triangular planar base, said second rib means defining said spaced apart converging channels and also defining means for insertion between a pair of display sheet sections of a sign for separating the display sections of the sign and guiding the edges of the display sheet sections of the sign into the spaced apart converging channels, said second locking member being integral with said triangular planar base.

17. Apparatus as defined in claim 16 wherein said first member comprises a rectangular planar base and first integral rib means extending out of said rectangular planar base, said first rib means comprising at least two parallel ribs defining a guide channel for the central planar section of a sign.

18. Apparatus as defined in claim 17 wherein said first and second support members and all of the structure integral therewith are formed as a unitary, molded plastic article.

* * * * *